United States Patent [19]

Bradford et al.

[11] 4,335,842

[45] Jun. 22, 1982

[54] THREE COMPARTMENT DIVIDER

[75] Inventors: Judson T. Bradford; Charles L. Bradford, Jr.; Charles J. Shepherd, all of Holland, Mich.

[73] Assignee: W. J. Bradford Paper Company, Holland, Mich.

[21] Appl. No.: 215,620

[22] Filed: Dec. 12, 1980

[51] Int. Cl.[3] ..... B65D 5/48

[52] U.S. Cl. ..... 229/15

[58] Field of Search ..... 229/15, 27

[56] References Cited

U.S. PATENT DOCUMENTS

| | | | |
|---|---|---|---|
| 2,267,378 | 12/1941 | Snelling . | |
| 3,184,142 | 5/1965 | Rosenburg | 229/28 R |
| 3,770,184 | 11/1973 | Rockefeller | 229/15 |
| 3,984,046 | 10/1976 | McMahon | 229/15 |
| 4,102,525 | 7/1978 | Albano | 229/15 |
| 4,293,091 | 10/1981 | Gerard | 229/15 |

*Primary Examiner*—Herbert F. Ross

*Attorney, Agent, or Firm*—Wood, Herron & Evans

[57] ABSTRACT

A compartment defining partition member is disclosed for insertion into a rectangular shipping case so as to divide that case into three separated compartments. The partition member comprises a single length blank of fiberboard folded on parallel cut-score and score lines. The folds are such that the inherent tendency of the folded panels to return to the unfolded condition of the blank biases the ends of the blank against diagonally opposed corners of the case to effectively resist displacement of the partition within the case as well as withdrawal of the partition from the case.

5 Claims, 6 Drawing Figures

THREE COMPARTMENT DIVIDER

This invention relates to packaging and particularly to shipping cases having internal partitioning that is readily installed and reliably maintains a compartment defining condition within the case.

Traditionally, bottles and other multi-packed items have been shipped in shipping cases containing corrugated or fiberboard slotted partitions. These slotted partitions were configured much like conventional egg crate partitions. The function of the partitions was to provide complete cellular separation between the bottles or individual packaged items witin the case so as to provide cushioning between the bottles or packaged items as well as to lend some vertical compression strength to the shipping case.

There has been a growing trend to replace the conventional slotted partitions in bottle shipping cases with corrugated dividers which form only two or three compartments within the shipping case, but primarily function to add vertical rigidity to the shipping case within which the partition is located. One such partition or divider which has been developed and is now in widespread use for this purpose is a so-called "H divider". The "H divider" is made from a single piece of fiberboard material cut and scored so that when erected and inserted into the case and viewed from the open top, the divider has the configuration of "H" dividing the interior of the case into two compartments. The "H divider" exhibits substantial increased compression strength over the more traditional slotted partitions and additionally is much less expensive to manufacture.

The "H divider" has several undesirable characteristics for a divider which is primarily intended to add vertical rigidity to the shipping case within which it is located. Among those disadvantages is the fact that the sheet or blank from which the "H divider" is made is scored along the top edge of the divider and folded. When folded, the outside sheet of the double face corrugated board blank comprising the "H divider" compresses the sinusoidal shaped sheet of material sandwiched between and adhered to the exterior sheets of material of the corrugated board blank. The result is that the two panels of the "H divider" formed by the folding of the corrugated board blank are shorter than the panels cut from the blank. Consequently the "H divider" has uneven height panels resulting in nonuniform and non-simultaneous top loading when the shipping case containing the divider is placed in vertical compression, resulting in lower compression strength than would be the case if a sheet or blank were scored to form the side edges of the divider and there were straight aligned edges of equal height along the top surfaces of the divider.

The conventional "H divider" now in use also has less than optimal compressive strength because the two panels formed by scoring and folding the double-face corrugated board blank are topped by a rounded crown caused by the compression of the sinusoidal shaped sheet of material sandwiched between the exterior sheets of the corrugated board blank. When the divider containing carton is placed in vertical compression, the rounded crown at the top of the two panels formed by folding the blank provides less compressive strength than would be the case if the two panels had straight aligned edges of equal height along the top surface of the divider.

The "H divider" also suffers from the fact that scoring and folding the double-face corrugated board blank and compressing the sinusoidal shaped sheet sandwiched between the exterior sheets of the blank results in panels that, to a greater or lesser degree, are not uniform in height. The result is that the bottom edge of one of the panels formed by folding the blank overlaps the bottom edge of the other panel, resulting in panels that are not uniformly loaded when the divider containing carton is placed in vertical compression, resulting in less compressive strength than would be the case if the straight edges along the bottom of the two panels were accurately aligned with one another.

Another prior art divider commonly in use is disclosed in Snelling U.S. Pat. No. 2,267,378. While this patent is directed to a merchandise display device, in fact the device illustrated in FIGS. 1 and 2 of this patent has been used in the past in shipping containers as partitions or dividers. When used as a partition, the device disclosed in this Snelling patent also suffers many of the shortcomings of the "H divider". Specifically, the partition is scored and folded along portions of its top edge and therefore suffers many of the disadvantages inherent in the "H divider" described hereinabove. Specifically, because of the presence of the fold along the top and bottom edges, the partition varies in height and therefore the vertical compression strength of the divider is substantially impaired by the height variance.

The divider disclosed in this Snelling patent also is characterized by a high manufacturing cost because of the relatively high cost of the equipment required to manufacture it.

Still another common type of divider employed in the past to impart vertical rigidity of a shipping case is disclosed in U.S. Pat. No. 3,770,184 to Rockefeller. This Rockefeller divider has certain advantages over the "H divider" but suffers many of the same inherent problems. Specifically, this Rockefeller patent divider in most configurations of shipping containers locates a cross panel of the partition over the "gap" section of the shipping container located between the edges of the closed end flaps of the container. When so located this cross panel has no contact with the loading perimeter of the case. Because of this lack of contact in vertical compression with the carton, this cross panel contributes little if anything to compression strength of the container.

The divider disclosed in this Rockefeller patent also is objectionable because it requires substantially more material to form the partition than is desirable, and additionally because it requires the partition to be glued during assembly. The inclusion of glue joints often leads to misalignment of the glued panels within the carton with the result that they often load nonuniformly and thus reduce the compression strength of the shipping case containing the divider below what is expected for aligned panel dividers.

It has been an objective of this invention to overcome all of the disadvantages set forth hereinabove as being characteristic of the "H divider", the divider of the Snelling patent, or the divider of the Rockefeller patent.

The three compartment divider of this invention which accomplishes these objectives and overcomes these disadvantages is formed from an elongated constant width blank folded double upon itself about a cut-score line, or any other type of score line that will facilitate a 180° fold of the blank. Each half of the folded blank comprises three panels defined by two transverse score lines. The end panels of each folded half of the blank are overlapped when the partition is expanded and the center panels of each half are spaced apart in parallel relationship. When placed in a shipping case the spaced parallel cross panels extend parallel to the end walls of the shipping case. Inherent resiliency of the divider along the fold lines is such that it tends to try to return to the collapsed flat condition so that the ends of the expanded panel are biased into contact with opposed corners of the shipping case. This end bias effectively resists displacement of the blank within the case as well as withdrawal of the blank from the case.

This three compartment divider has the advantage over the dividers of the prior art described hereinabove of imparting greater vertical rigidity to a shipping carton than these prior art dividers are capable of imparting with the same amount of material. It also has the advantage of being less expensively manufactured with less scrappage and less waste of material.

These and other objects and advantages will be more readily apparent from the following description of the drawings in which.

Figures 1, 2, 3, 4, 5, 6:
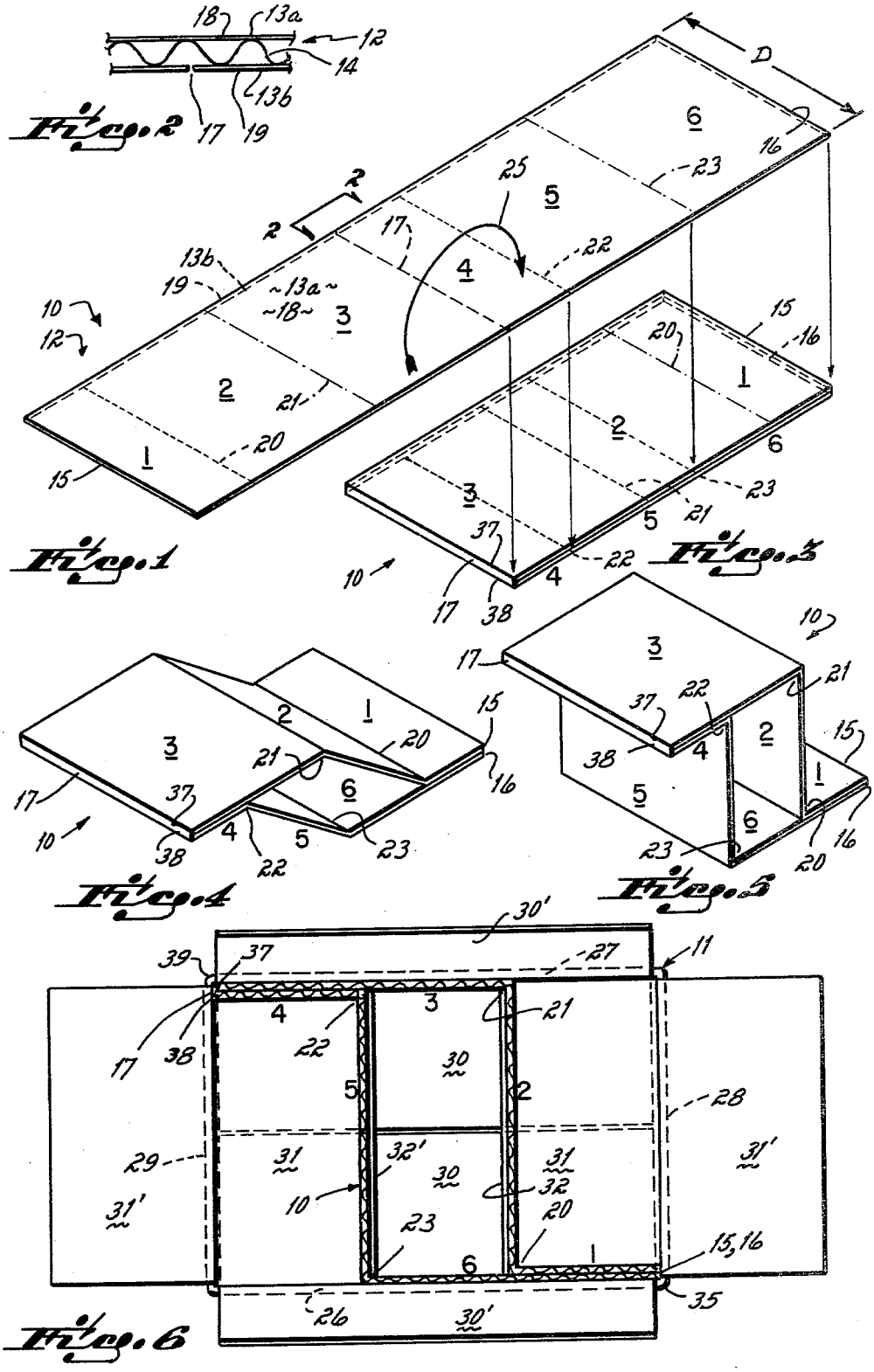
FIG. 1 is a perspective view of a cut and scored blank utilized in the manufacture of the three compartment partition which is the subject of this invention.
FIG. 2 is a side view taken on line 2—2 of FIG. 1.
FIG. 3 is a perspective view of a folded partition in a collapsed condition prior to erection.
FIG. 4 is a perspective view of the partition partially erected.
FIG. 5 is a perspective view of the erected partition.
FIG. 6 is a top plan view of the partition located within a shipping case.

The divider 10 of this invention is a three compartment divider intended to be inserted into a shipping case 11 so as to divide the interior of the case into three compartments and to add compressive strength to the case. Commonly such compartmented cases are utilized to ship bottles or other objects which are partially separated by the compartments. Such a three compartment case might contain three bottles or other objects to be shipped but more commonly would contain 6, 12 or 18 objects. The divider 10 is not intended to completely isolate or insulate each bottle or object within the case from one another but only to partially isolate and insulate the objects. More importantly though, the compartments function to add compressive strength to a carton and to maintain alignment of bottles or objects as they are inserted into the case or as they are removed by automatic machinery.

The divider 10 is manufactured from an elongated rectangular blank 12 of double-face corrugated cardboard. As may be seen in FIG. 2, double-face corrugated board comprises two sheets of material 13*a* and 13*b* between which there is sandwiched and adhered a sinusoidal shaped sheet of material 14. The blank 12 is of constant width from one end 15 to the other 16. It is divided medially of its length by a transverse cut-score line 17 which extends perpendicular to the top and bottom edges 18 and 19 of the blank. Additionally, there is a pair of transverse score lines 20, 21 on one side of the cut-score line 17 and another pair of transverse score lines 22, 23 located on the other side of the cut-score line 17. One of each pair of score lines 20, 21 and 22, 23 is located on the reverse side of the blank from the other score line of each pair.

As used in the specification and claims of this application, the term "cut-score line" is used geometrically to define any form of score line which enable a blank to be folded 180° about the score line.

In order to erect the divider, it is first folded double about the cut-score line 17 as indicated by the arrow 25 of FIG. 1. The doubled over flat blank is then erected by maintaining the end panels 1 and 6 in surface to surface contact while panels 3 and 4 are similarly mantained in contact. By raising the third and fourth juxtaposition panels relative to the first and sixth panels, as indicated in FIG. 4, the erected divider may be sequentially moved into the positions illustrated in FIGS. 4 and 5. When in the erected position illustrated in FIG. 5, the erected divider may be inserted into an open top of the shipping container 11.

The container illustrated in FIG. 6 is a regular slotted container having side walls 26, 27, end walls 28 and 29, side wall flaps 30, 30' attached to the bottom and top edges of the side walls, and end wall flaps 31, 31' attached to the bottom and top edges of the end walls. This type of conventional shipping container 11 is commonly referred to as a regular slotted container.

Except for square shipping cases or cartons which have side and end walls of equal length, every regular slotted container or carton has a gap between the edges 32, 32' of the end wall flaps. Therefore, the inside height dimension of the carton is significantly greater in the flap gap than on the minor or end wall flaps. It is to be noted that the cross panels 5 and 2 of the erected carton divider extend between the side walls 26, 27 of the carton and are located on the end wall flaps 31,31'. By so locating the cross panels of the erected partition, the vertical compressive strength of the carton or shipping case 11 containing the divider 10 is substantially increased over what it would be if any part of the cross panels 5 and 2 were located in the gap between the edges 32, 32' of the end wall flaps 31, 31'.

In the erected carton, the inside height of the carton between the end flaps 31, 31' when the top and bottom end flaps are closed, is the same as the transverse dimension D of the divider blank 12. Consequently, the assembled three compartment divider of this invention when located within the carton imparts substantial vertical compressive rigidity to the carton.

It is to be noted that the edges 15 and 16 of the erected divider are located in one corner of the carton and the outside wall of panel No. 6 of the divider is located flush against the inside surface of the side wall 26. The edges 37, 38 of the panels numbered 3 and 4 similarly are biased into a corner 39 of the carton diagonally opposite the corner 35 and the outside wall of the panel numbered 3 is flush against the inside surface of the side wall 27 of the carton. When thus located within the carton the inherent resiliency of the erected divider tends to cause the divider to try to move toward the flat condition illustrated in FIG. 3. This resiliency thus tends to maintain the edges 15 and 16, 37 and 38 of the partition in contact with the corners of the carton and the cross panels 2 and 5 aligned parallel to the end walls of the carton. Additionally, this inherent resiliency of the divider tends to prevent the divider from falling out of the carton whenever the carton is inverted to dump the contents from it.

The three compartment divider described and illustrated herein has numerous advantages over conventional prior art two and three compartment dividers which have preceded it. One of those advantages is that the divider illustrated herein may be over-folded past the position illustrated in FIG. 5 so as to collapse the divider in two dimensions smaller than the carton opening through which it must be inserted into the carton. When so collapsed, it may be easily inserted into a carton either manually or by a mechanical loading device. Many of the competitive prior art partitions may not be so collapsed, and are therefore much more difficult to insert into a carton.

This divider also has the advantage over many competitive dividers in that it has no folds or creases along its top and bottom edges. Those folds or creases cause the vertical height of the panel to be varied and thus the compressive strength of the carton imparted by the divider to be substantially reduced.

Another advantage of this divider over prior art dividers which have preceded it is that it does not require the overlapped panels numbered 1 and 6 and 3 and 4 to be glued or otherwise adhesively secured to one another. The panels of this invention are preferably not glued or adhered to one another. Gluing has the disadvantage of increasing the complexity and cost of manufacture and additionally of substantially weakening the vertical compressive strength of the divider containing carton if there is any misalignment between the glued panels. When left unglued, the panels are self-aligning so that there is no resulting weakness caused by misalignment during the adhesion process.

While we have described only a single preferred embodiment of our invention, persons skilled in this art will appreciate numerous changes and modifications which may be made without departing from the spirit of our invention. Therefore, we do not intend to be limited except by the scope of the following appended claims.

We claim:

1. In combination with a rectangular shipping case having parallel end walls and parallel side walls, an inserted one-piece compartment defining member formed from an elongated blank of constant width and comprising six series connected panels, each panel having a transverse width substantially equal to the height of the compartments to be formed by said compartment defining member, said adjacent panels of said elongated blank being hingedly connected by only five parallel transverse fold lines, one of said fold lines being formed by a cut-score line located medially of the length of said elongated blank, the remaining four of said fold lines comprising two pairs of score lines, each pair of score lines being located on opposite sides of said cut-score line, and each score line of each pair being located on opposite sides of said elongated blank, said elongated blank being folded and having its opposite end panels juxtapositioned in overlapping relationship, and its two central panels juxtapositioned in overlapping relationship, said folded blank being capable of being collapsed to substantially flat condition or of being expanded, said folded blank when in expanded condition having those panels which are adjacent the end panels spaced apart and extending parallel to one another, and when in said case, parallel to the end walls of said case, said overlapped panels of said expanded blank being located in flush engagment with said side walls of said case and having the ends thereof in contact with diagonally opposed corners of said case, and said expanded folded blank having such inherent resiliency at the fold lines due to the tendency of the panels to return toward the collapsed flat condition of the blank as to bias said expanded blank against the case walls to effectively resist displacement of said blank within the case as well as withdrawal of the blank from the case.

2. The combination of claim 1 in which said shipping case has side flaps and end flaps connected to the bottom edges of said side wall and end walls, respectively, said end wall flaps being folded inwardly to form the bottom of said case and said side wall flaps being folded inwardly over said end wall flaps, and said parallel spaced apart panels of said expanded folded blank having bottom edges, said bottom edges of said parallel spaced apart panels being supported for the full length of said bottom edges on the top surface of said inwardly folded end flaps of said carton.

3. In combination with a rectangular shipping case having parallel end walls and parallel side walls, an inserted one piece three compartment defining member formed from an elongated blank of equal width and only fine parallel fold lines transverse to the length of said blank, said elongated blank being formed into two equal length elongated blank sections of constant and equal width, each section comprising only three series connected adjacent panels, each panel having a transverse width substantially equal to the height of the compartments to be formed by said compartment defining member, said three panels of each of said blank sections being hingedly connected by a pair of parallel transverse score lines, each score line of each pair being located on opposite sides of one of said blank sections, said outside panels of each said blank being of unequal length, the length of one outside panel of said blank being approximately twice the length of the other outside panel of said blank, said blank section being overlaid one atop the other in a substantially flat condition and being capable of being expanded, said overlaid blank sections when in expanded condition having the center panels spaced apart and extending parallel to one another, and when in said case, parallel to the end walls of said case, the end panels of said expanded blank sections being juxtapositioned in overlapping relationship and located in flush engagement with said side walls of said case and having the end edges thereof in contact with diagonally opposed corners of said case, said expanded blank sections having such inherent resiliency at the fold lines due to the tendency of the panels to return toward the collapsed flat condition of the blank sections as to bias said expanded blank against the case walls to effectively resist displacement of said blank within the case as well as withdrawal of the blank from the case.

4. The combination of claim 3 in which said shipping case has side flaps and end flaps connected to the bottom edge of said side walls and end walls, respectively, said end wall flaps being folded inwardly to form the bottom of said case and said side wall flaps being folded inwardly over said end wall flaps, and said parallel spaced apart center panels of said expanded blank sections having bottom edges, said bottom edges of said parallel center panels being supported for the full length of said bottom edges on the top surface of said inward folded end flaps of said carton.

5. A compartment defining member for use in combination with a rectangular shipping case having parallel end walls and parallel side walls, said compartment defining member being formed from an elongated blank of constant width and comprising six series connected panels, each panel having a transverse width substantially equal to the height of the compartments to be formed by said compartment defining member, said six adjacent panels of said elongated blank being hingedly connected by only five parallel transverse fold lines, one of said fold lines being formed by a cut-score line located medially of the length of said elongated blank the remaining for of said fold lines comprising two pairs of score lines, each pair of score lines being located on opposite side of said cut-score line, and each score line of each pair being located on opposite sides of said elongated blank, said elongated blank being folded and having its opposite end panels juxtapositioned in overlapping relationship, and its two central panels juxtapositioned in overlapping relationship, said folded blank being capable of being collapsed to substantially flat condition or of being expanded, said folded blank when n expanded condition having those panels which are adjacent the end panels spaced apart and extending parallel to one another, one of said overlapped end panels of said expanded blank being adapted to be located in flush engagement with each of said side walls of said case, and the ends of said expanded blank being adapted to be placed in contact with diagonally opposed corners of said case, and said expanded folded blank when located in said case having such inherent resiliency at the fold lines due to the tendency of the panels to return toward the collapsed flat condition of the blank as to bias said expanded blank against the case walls to effectively resist displacement of said blank within the case as well as withdrawal of the blank from the case.

* * * * *

UNITED STATES PATENT AND TRADEMARK OFFICE

CERTIFICATE OF CORRECTION

PATENT NO. : 4,335,842

DATED : June 22, 1982

INVENTOR(S) : Judson T. Bradford, et al

It is certified that error appears in the above—identified patent and that said Letters Patent is hereby corrected as shown below:

Claim 5, column 7, line 15 "for" should be -- four --

Claim 5, column 7, line 17, "side" should be -- sides -

Signed and Sealed this

*Eighth* Day of *March 1983*

[SEAL]

*Attest:*

GERALD J. MOSSINGHOFF

*Attesting Officer*

*Commissioner of Patents and Trademarks*